US008070263B2

(12) United States Patent
Oohashi et al.

(10) Patent No.: US 8,070,263 B2
(45) Date of Patent: Dec. 6, 2011

(54) PRINTING HEAD SUBSTRATE, INK JET PRINTING HEAD AND INK JET PRINTING APPARATUS WITH SUBSTRATE TEMPERATURE DETECTING ELEMENT

(75) Inventors: Ryoji Oohashi, Yokohama (JP); Yoshiyuki Imanaka, Kawasaki (JP); Koichi Omata, Kawasaki (JP); Hideo Tamura, Kawasaki (JP); Takaaki Yamaguchi, Yokohama (JP); Kousuke Kubo, Yokohama (JP); Yuuji Tamaru, Yokohama (JP); Masafumi Takimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 12/480,249

(22) Filed: Jun. 8, 2009

(65) Prior Publication Data

US 2009/0309913 A1 Dec. 17, 2009

(30) Foreign Application Priority Data

Jun. 17, 2008 (JP) ..... 2008-157877

(51) Int. Cl.
*B41J 2/05* (2006.01)

(52) U.S. Cl. ..... 347/58; 347/65; 347/57

(58) Field of Classification Search ..... 347/14, 347/17, 19, 50, 56–59, 65, 67, 15
See application file for complete search history.

(56) References Cited

U.S. PATENT DOCUMENTS

| | | | | |
|---|---|---|---|---|
| 5,175,565 | A | 12/1992 | Ishinaga et al. | |
| 6,557,983 | B1 * | 5/2003 | Inoue | 347/65 |
| 6,945,629 | B2 * | 9/2005 | Yamaguchi et al. | 347/48 |
| 2005/0179745 | A1 | 8/2005 | Yamaguchi et al. | |

FOREIGN PATENT DOCUMENTS

| | | |
|---|---|---|
| JP | 02-258266 | 10/1990 |
| JP | 2004-050637 | 2/2004 |

* cited by examiner

*Primary Examiner* — Juanita D Stephens
(74) *Attorney, Agent, or Firm* — Fitzpatrick, Cella, Harper & Scinto

(57) ABSTRACT

There are provided a printing head substrate, an ink jet printing head and an ink jet printing apparatus, which accurately detect a temperature state in the central part of a heater array on the substrate and restrict an area of the substrate to a minimum. A printing head substrate has a plurality of heating elements, a plurality of ink supply openings, a logic circuit for driving the heating elements; a substrate temperature detecting element for detecting a temperature of the printing head substrate, and input and output pads for carrying out reception and supply of a signal between a printing apparatus, and the logic circuit and the substrate temperature detecting element, wherein a beam integral with the substrate is provided between the plurality of ink supply openings, and the substrate temperature detecting element is arranged on the beam.

6 Claims, 22 Drawing Sheets

PRINTING HEAD SUBSTRATE, INK JET PRINTING HEAD AND INK JET PRINTING APPARATUS WITH SUBSTRATE TEMPERATURE DETECTING ELEMENT

BACKGROUND OF THE INVENTION

1. Field of the Invention

The present invention relates to a printing head substrate, an ink jet printing head and an ink jet printing apparatus, and particularly, to a printing head substrate, an ink jet printing head and an ink jet printing apparatus, which are provided with a substrate temperature detecting element.

2. Description of the Related Art

An ink jet printing head mounted in an ink jet printing apparatus ejects ink droplets from ejection openings in various ways to attach the ink droplets onto a print medium such as a print paper, thus carrying out the printing. Among others, the ink jet printing head using heat as energy for ejecting ink can relatively easily realize a multi-nozzle system in high concentration, carrying out the printing with high resolution, of high image quality and at high speeds. There is known a so-called side shooter type of ink jet printing head as one of systems for ejecting ink using this kind of thermal energy, which ejects ink droplets perpendicularly on a surface on which heating resistive elements (heating elements) generating thermal energy are formed. In this type of printing head, ink supply at ink ejecting is generally carried out through ink supply openings penetrating through a substrate from a backside of the substrate provided with the heating resistive elements.

In the substrate of this side shooter type ink jet printing head, a plurality of heating resistive elements (hereinafter, also referred to as heaters simply) are provided at one side of the ink supply opening penetrating through the substrate centering the ink supply opening. Further, members are formed for forming ink ejection openings and ink flow passages for ejecting ink to correspond to the respective heating resistive elements. Such an ink jet printing head is formed of a monolithic configuration by a silicon semiconductor substrate based upon a semiconductor manufacture technology. Further, the ink jet printing head is provided with substrate temperature detecting elements because of a close relation between an ejection characteristic of ink droplets from the ejection opening and a substrate temperature.

FIG. 21 is a schematic diagram showing a construction of a conventional printing head substrate. There is, as shown in FIG. 21, known the conventional printing head substrate in which substrate temperature detecting elements 7 made of diode are arranged in the adjacency of input and output pads 12 and 13 (for example, refer to Japanese Patent Laid-Open No. 2004-050637). The substrate temperature detecting element 7 detects a temperature of the substrate, and a drive pulse is adjusted based upon the detected temperature information. This adjustment allows the printing without variations in image density even if a temperature difference occurs in the printing head substrate.

There is further known a printing head substrate on which substrate temperature detecting elements such as diode sensors are formed (for example, refer to Japanese Patent Laid-Open No. H2-258266 (1990)). It is possible to read a substrate temperature with high accuracy by forming the temperature sensor in the printing head substrate. This type of temperature sensor is used for controlling an ink ejection characteristic changing with heat generated at the time each power source consumes electric current. This type of temperature sensor is further used for forcibly and temporarily stopping the sequence by using a monitor value of the temperature sensor when an abnormality such as power source short occurs on the substrate to create an abnormal temperature increase.

In most of recent ink jet printing apparatuses, there is mainly used a printing head which has a plurality of ink supply openings within one substrate and a plurality of heaters are arranged in high concentration to correspond to the ink supply openings for obtaining an image with high resolution and of high image quality at high speeds. Since a high concentration arrangement of heater arrays is recently possible, the printing head substrate is, as shown in FIG. 21, configured to have one heater array to the one ink supply opening at one side thereof for downsizing the printing head substrate. Further, for achieving high-speed printing, the number of heaters per one heater array increases, and in consequence, there is a printing head substrate in which the heater arrangement array has a length of one inch or more. In such a substrate construction, the temperature detecting location is required to be a plurality of locations, such as locations not only near the pad as conventional but also in the adjacency of the central part in the heater array.

In the printing head substrate as shown in FIG. 21, however, in a case where an abnormal temperature increase occurs in the central part of the heater array 6, since a difference in the temperature distribution in the substrate occurs because of a distance from the central part of the heater array 6 until the temperature sensor 7 in the adjacency of the pad 12, a temperature in the central part of the heater array 6 may not be detected accurately. This problem is the more remarkable as the printing head substrate becomes the longer. Therefore, it is required to set the temperature sensor at a desired position for accurately detecting the temperature in the central part of the heater array.

FIG. 22 is a schematic diagram showing the construction of the printing head substrate in which the temperature detecting elements 7 are arranged near the central part of the heater array 6. In the substrate shown in FIG. 22, a logic circuit 15 such as a shift resister and a driver transistor 16 are arranged in such a manner as to be capable of reading out the temperature detecting sensors individually.

Even in the printing head substrate as constructed above, the substrate temperature detecting element made of diode has a large occupying area, and therefore, it is required to further provide a space for the temperature detecting element. That is, in a case of locating the temperature detecting element at the central part of the heater array, it leads to an increase in chip size, that is, substrate size.

In a case of detecting temperatures of the temperature sensors at plural locations, a logic circuit such as a shift resister is required for selecting a desired temperature sensor. In this case, it is preferable to locate the logic circuit near the temperature sensor in such a manner as to constitute one integral system. However, when the logic circuit is too close to the heater, it possibly causes instability in an operation thereof due to heat and therefore, it is required to locate the temperature sensor near the heater and locate the logic circuit at a position where it is not so much influenced by heat of the heater. However, when the temperature sensor is arranged in the center, the substrate size remarkably increases. In a case of the elongated substrate, a length of the printing substrate tends to be much larger than a lateral width thereof. Such a substrate of a large aspect ratio also possibly creates the problem with a mechanical strength of the substrate itself.

SUMMARY OF THE INVENTION

The present invention is made in view of the forgoing problems and an object of the present invention is to provide a printing head substrate, an ink jet printing head and an ink jet printing apparatus, which accurately detect a temperature state in the central part of a heater array on the substrate and restrict an area of the substrate to a minimum. Another object of the present invention is to provide a printing head substrate, an ink jet printing head and an ink jet printing apparatus, which improve also a mechanical strength of the printing head substrate.

For achieving the above objects, according to the present invention, a printing head substrate comprising, a plurality of heating elements generating energy for used ejecting the ink from ejection openings, a plurality of ink supply openings for supplying ink to the plurality of heating elements, a logic circuit for driving the heating elements, a substrate temperature detecting element for detecting a temperature of the printing head substrate, and input and output pads for carrying out reception and supply of a signal between a printing apparatus, and the logic circuit and the substrate temperature detecting element, wherein a beam integral with the substrate is provided between the plurality of ink supply openings, and the substrate temperature detecting element is arranged on the beam.

According to the above construction, providing the beam at the ink supply opening causes the temperature monitor even in the central part of the substrate to be carried out accurately. Since the substrate temperature detecting element is formed on the beam integral with the ink supply opening, a further space for the substrate temperature detecting element is not required and therefore, the downsizing of the printing substrate is possible. In addition, due to the formation of the beam, even the elongated substrate of a large aspect ratio can maintain a mechanical strength of the substrate.

Further features of the present invention will become apparent from the following description of exemplary embodiments (with reference to the attached drawings).

DESCRIPTION OF THE EMBODIMENTS

Hereinafter, embodiments of the present embodiment will be in detail explained with reference to the accompanying drawings.

First Embodiment

1. Printing Apparatus

Figure 1:
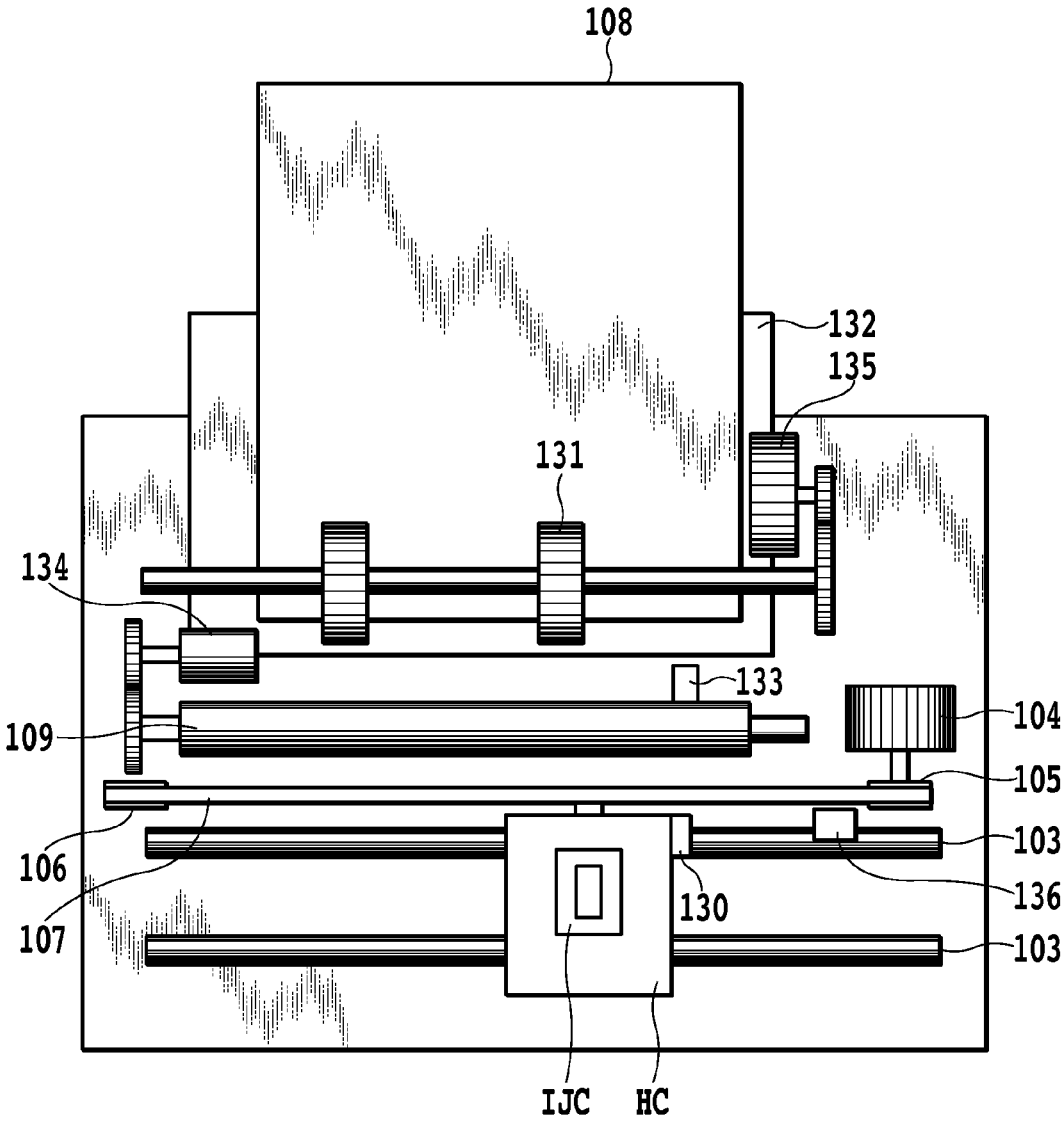
FIG. 1 is a schematic diagram showing a printing apparatus according to the first embodiment of the present invention.

FIG. 1 is a schematic diagram showing a printing apparatus of the present embodiment.

A printing head cartridge IJC is configured by combining a printing head IJH provided with a printing head substrate to be described later with a container accommodating ink. The printing head cartridge IJC is positioned at a carriage HC and is mounted thereon to be replaceable. The carriage HC is provided with an electrical connection portion for transmitting a drive signal through an external signal input terminal on the printing head cartridge IJC to each ejection opening.

The carriage HC is guided and supported by guide shafts 103 disposed in an apparatus to extend in a main scan direction in such a manner as to reciprocate along the guide shafts 103. The carriage HC is driven through a drive mechanism such as a motor pulley 105, a driven pulley 106 and a timing belt 107 by a main scan motor 104, and also a position and a movement of the carriage HC are controlled by the main scan motor 104. A home position sensor 130 is provided in the carriage HC. Thereby, when the home position sensor 130 on the carriage HC passes a position of a shield board 136, it is possible to detect a position of the carriage HC.

A print medium 108 such as a print sheet or a plastic thin plate is fed so as to be separated one by one from an auto sheet feeder (ASF) 132 by rotating a pickup roller 131 through a gear by a sheet feeding motor 135. The printing medium 108 passes, by rotation of a conveying roller 109, a position (print part) facing a ejection opening face of the printing head cartridge IJC and is conveyed in a sub scan direction. The conveying roller 109 is rotated through a gear by rotation of an LF motor 134. Then, the determination as to whether or not the sheet is fed and the fixation of a rewinding position at sheet feeding are made at a point where the print medium 108 passes a paper end sensor 133. The paper end sensor 133 is also used for finding where a rear end of the print medium 108 is actually and finally determining the present print position from the actual rear end.

The print medium 108 has a back side supported by a platen (not shown) in such a manner as to form a flat print face at the print part. In this case, the printing head cartridge IJC mounted in the carriage HC has the ejection opening face protruding downwards from the carriage HC and is held in such a manner as to be in parallel with the print medium 108 between two sets of conveying rollers.

The printing head cartridge IJC is mounted in the carriage HC in such manner that a line direction of the ejection openings in the respective ejection parts intersects with a scan direction of the carriage HC described above, and carries out the printing by ejecting liquids from the ejection opening array.

The printing apparatus is provided with a signal supply unit supplying and receiving a drive signal for driving a heating resistive element and a signal for temperature detection to and from the printing head (printing head substrate). A system of the printing apparatus detects a temperature of each temperature detecting element located on the head substrate at the time temperatures of the printing head IJH are uniform, such as at the time the power source is switched on. Temperatures of the respective sensors are synchronized using a detection temperature of the diode sensor as reference.

At the time of driving the printing head IJH, based upon temperature information from the plural temperature detecting elements arranged on the printing head substrate, a drive pulse of the heater corresponding to the temperature detecting element is adjusted to drive the printing head IJH. In consequence, even if a temperature difference occurs in the printing head substrate, the printing without variations in image density is possible by adjusting the drive pulse.

2. Printing Head

Figure 2:
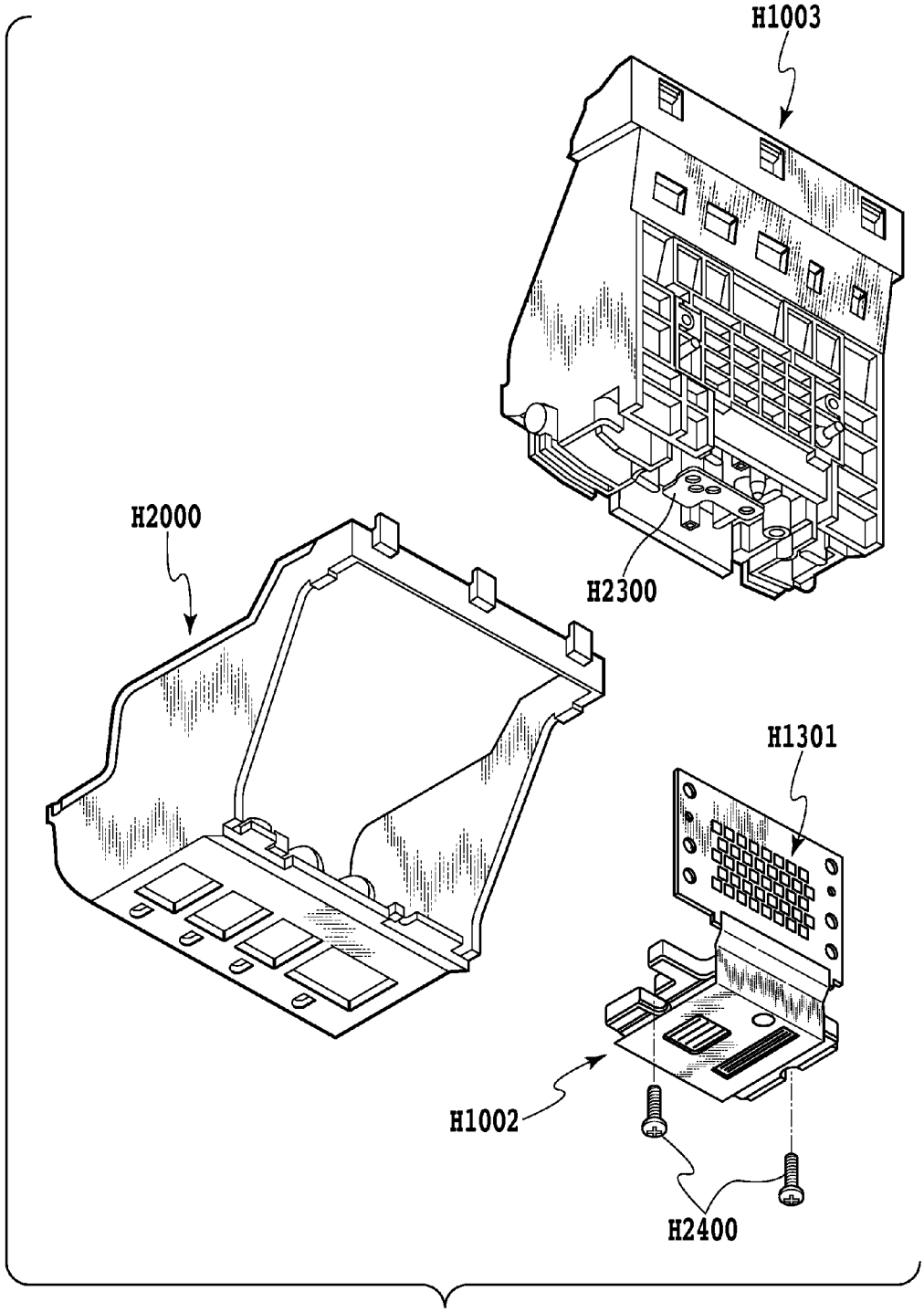
FIG. 2 is an exploded perspective view showing a printing head IJH according to the first embodiment of the present invention.

FIG. 2 is an exploded perspective view showing the printing head IJH of the present embodiment. The printing head IJH of the present embodiment is constructed of a printing element unit H1002, an ink supply unit H1003 as a printing liquid supply unit and a tank holder H2000. An ink communicating opening of the printing element unit H1002 and an ink communicating opening of the ink supply unit H1003 are fixed through a joint seal member H2300 by screws H2400 to contact the units H1002 and H1003 under pressure for communicating with each other without leakage.

Figure 3:
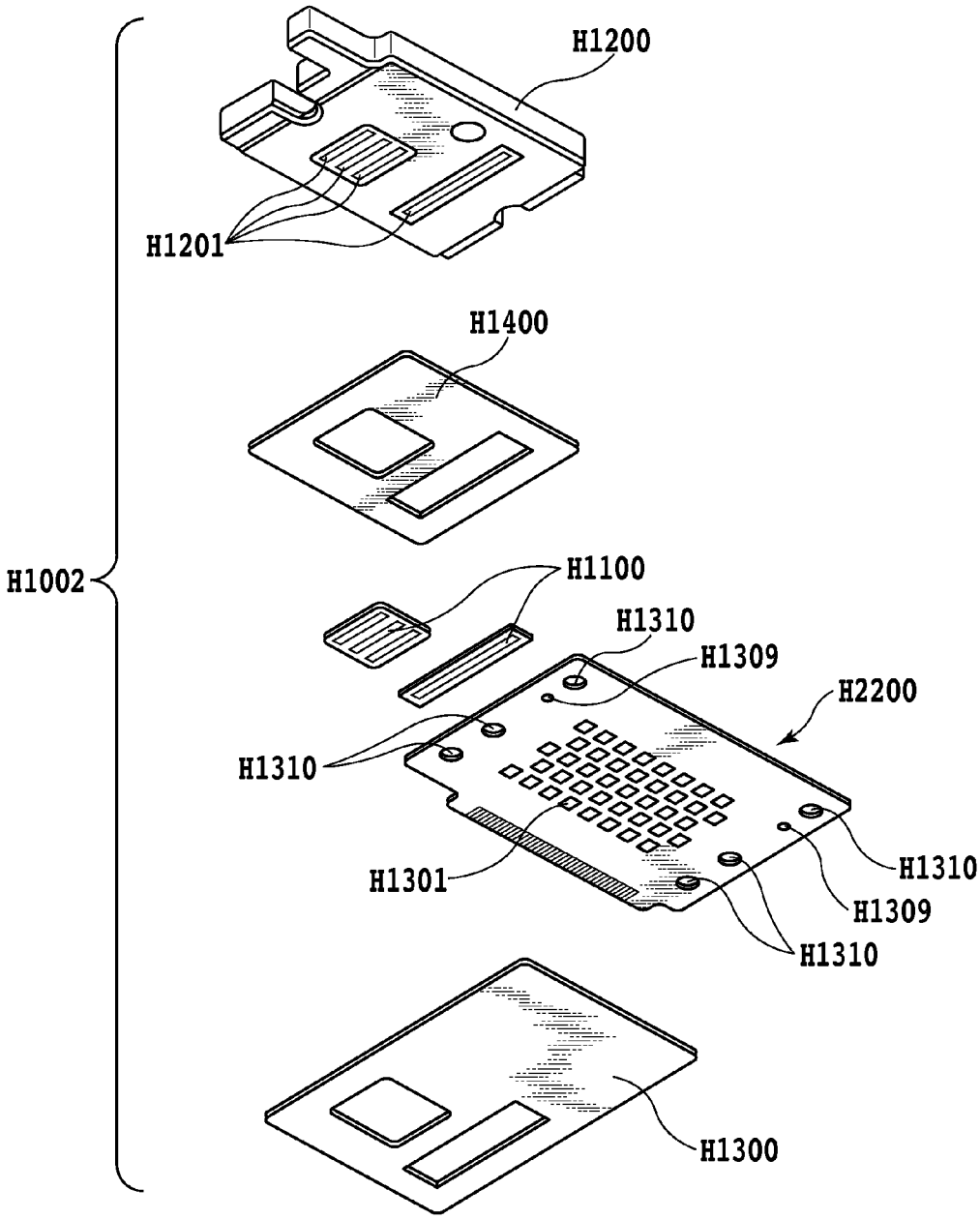
FIG. 3 is an exploded perspective view showing a printing element unit according to the first embodiment of the present invention.

FIG. 3 is an exploded perspective view showing the printing head unit H1002. The printing head unit H1002 is constructed of two printing head substrates H1100, a first plate (first support member) H1200, an electrical wiring tape (flexible wiring substrate) H1300, an electrical contact substrate H2200 and a second plate (second support member) H1400.

The printing head substrates H1100 are adhered and fixed to the first plate H1200. The second plate H1400 having openings is adhered and fixed to the first plate H1200. The electrical wiring tape H1300 is fixed to the second plate H1400 and a position relation of the second plate H1400 with the printing head substrates H1100 is held. The electrical wiring tape H1300 applies an electrical signal to the printing head substrates H1100 for ejecting ink. The electrical wiring tape H1300 is connected to the electrical contact substrate H2200 having electrical wiring corresponding to the printing head substrate H1100 and external signal input terminals H1301 receiving an electrical signal from an ink jet printing apparatus. The electrical contact substrate H2200 is positioned by two terminal positioning holes H1309 and is fixed to the ink supply unit H1003.

Figure 4:
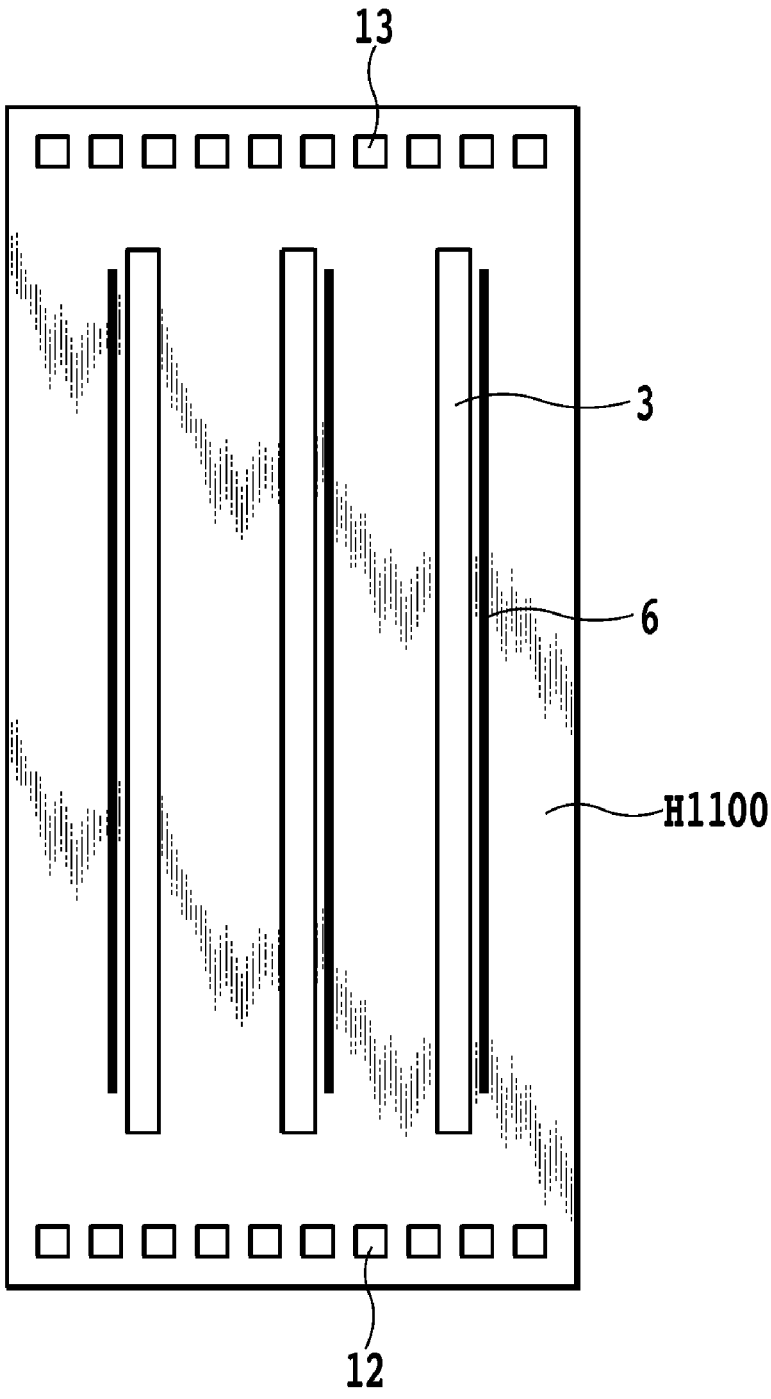
FIG. 4 is a schematic plan view showing an outline of a printing head substrate according to the first embodiment of the present invention.

FIG. 4 is a schematic plan view showing an outline of the printing head substrate H1100 in the present embodiment. The printing head substrate H1100 in the present embodiment is provided with a plurality of heating resistive elements (heaters) 6 disposed on one side of a Si substrate having a thickness of 0.5 to 1 mm for ejecting ink. Further, a plurality of ink flow passages (not shown) and a plurality of ejection openings (not shown) corresponding to these heating resistive elements 6 are formed by a photography technology. Ink supply openings 3 supplying the ink to the ink flow passages are formed in such a manner as to open to a surface (back side) at the other side of the substrate to correspond to the ink communicating openings H1201 formed in the first plate H1200. The ink supply opening 3 is formed by anisotropic etching using a crystal orientation of the Si substrate. That is, the ink supply opening 3 is formed so that the Si substrate has the crystal orientation of <100> in a wafer surface direction and <111> in a thickness direction. The anisotropic etching is carried out from the back side of the Si substrate by an alkali based element (KOH, TMAH or hydrazine). Thereby the etching is advanced at an angle of 54.7 degrees to form the ink supply opening 3 composed of an elongated groove-shaped through opening having a slant face from the back side of the substrate toward the surface thereof. The formation of the ink supply opening 3 may be performed by dry etching process or laser process instead of wet etching. The heating resistive elements (heaters) 6 are arranged in one line at one side of the ink supply opening 3. A drive element (not shown) switching on/off the heater 6 is located at a lower part of a power source common wiring layer. Since an ejection opening is provided facing the heater 6, the ink supplied from the ink supply opening 3 is ejected from the ejection opening by air bubbles generated by a heating function of the heating resistive element 6. In this figure, the heaters 6 are arranged in one line at one side of the ink supply opening 3, but may be arranged in one line at each of both sides of the ink supply opening 3.

Bumps on the electrode pads 12 of the printing head substrate H1100 fixed to the first plate H1200 and electrode leads of the electrical wiring tape H1300 are electrically connected by a thermal ultrasonic wave pressure method or the like. Therefore, an electrical signal is applied to the printing head substrate H1100 for ejecting ink.

Hereinafter, the printing head substrate H1100 in the present embodiment will be explained in detail.

3. Printing Head Substrate

Figure 5:
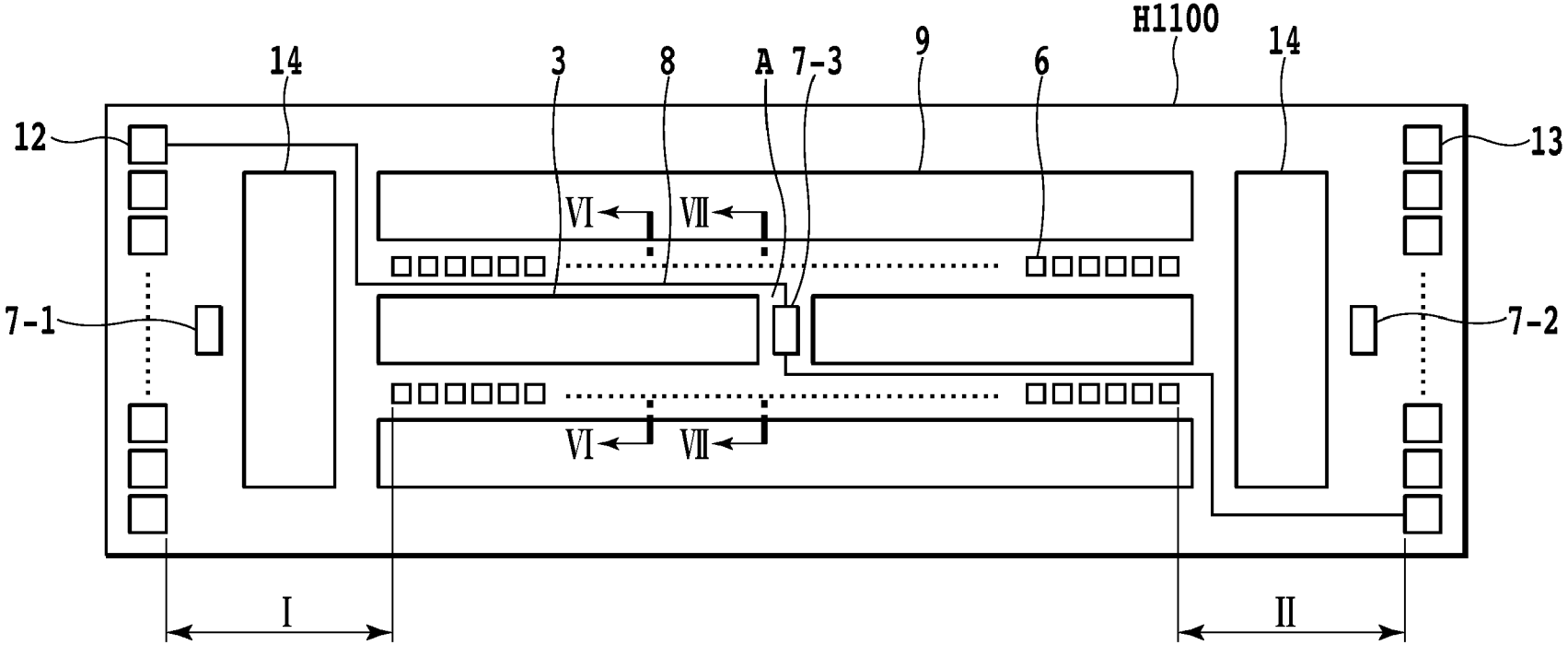
FIG. 5 is a schematic diagram showing the printing head substrate according to the first embodiment of the present invention.

FIG. 5 is a schematic diagram showing the printing head substrate in the present embodiment. The printing head substrate in the present embodiment has a plurality of elongated groove-shaped ink supply openings 3 penetrating the substrate within the substrate. The heaters 6 (heating elements) are arranged in one line at each of both sides of the printing head substrate along the ink supply opening 3. Heater logic circuits 14 are arranged at both sides of each heater array 6 for driving the heaters 6. The external connection terminals (input and output pads 12 and 13) such as power source terminals for the logic circuit and data signal terminals are arranged along ends of the substrate at short section sides of the ink supply opening. The input and output pads 12 and 13 may be arranged at ends of the substrate along the longitudinal direction of the ink supply opening.

The printing head substrate in the present embodiment is provided with a diode sensor 7-3 arranged on a beam A located perpendicular to the arrangement direction of the heater array 6, at the center of the ink supply opening 3. Then, a wire 8 extending to the diode sensor 7-3 goes between the heaters 6 and the ink supply opening 3 and is wired to the input and output pads 12 and 13. A multi wiring may be used to go through a lower layer of the heaters 6 and the driver 9, and is wired to the input and output pads 12 and 13.

Next, the ink supply opening 3 in the present embodiment will be explained. The supply opening is provided with a part penetrating the substrate and a beam, as shown in A in the figure, integral with the substrate.

Figure 6:
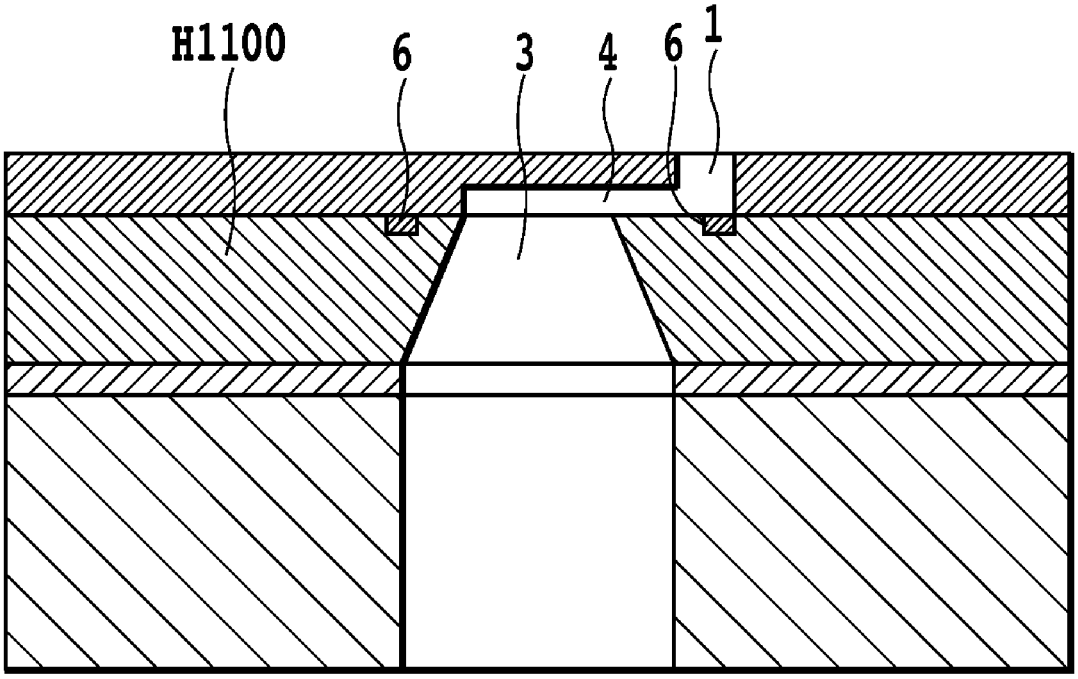
FIG. 6 is a VI-VI cross section in FIG. 5, that is, a schematic cross section showing a penetrating part of the substrate.
Figure 7:
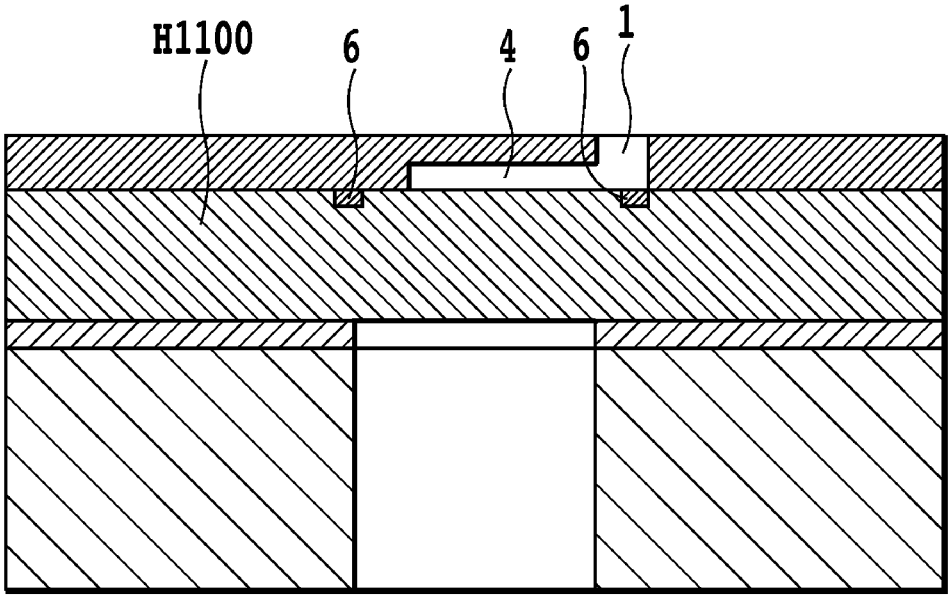
FIG. 7 is a VII-VII cross section in FIG. 5, that is, a schematic cross section showing a location where a beam is formed.

FIG. 6 is a VI-VI cross section in FIG. 5, that is, a schematic cross section showing a penetrating part of the substrate. FIG. 7 is a VII-VII cross section in FIG. 5, that is, a schematic cross section showing a location where a beam is formed.

The heaters 6 arranged at both sides of the ink supply opening 3 penetrating the substrate H1100 are provided on the substrate H100. A member is formed corresponding to the heaters 6 for forming an ink ejection opening 1 and an ink flow passage 4 for ejecting ink.

A beam part provided in the substrate H1100 is processed so that only the substrate constituting the beam part is not locally etched in FIG. 7. The outermost surface at the beam forming part is flush with a face on which the heater is formed. On the surface of the beam forming part, the temperature sensor made of a diode is formed by a semiconductor manufacturing process.

Figure 8:
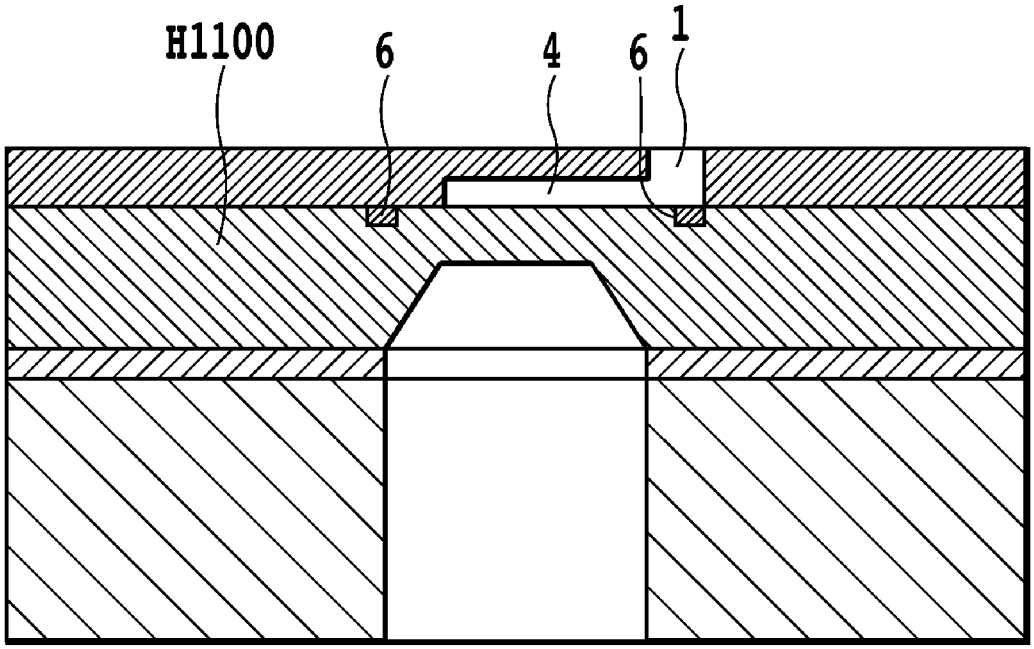
FIG. 8 is a schematic cross section showing another form of the VII-VII cross section in FIG. 5.

FIG. 8 is a schematic cross-sectional view showing another form in a VII-VII cross section in FIG. 5. As shown in FIG. 8, the beam part may be formed so that the substrate H1100 is recessed to the order of the half-depth in the thickness direction thereof.

In this way, the printing head substrate in the present embodiment is provided with the beam integral with the printing head substrate disposed at the ink supply opening and the temperature detecting element (diode sensor) arranged thereon. Therefore, it is possible to detect a temperature in the central part of the printing head substrate without increasing a size of the substrate. In addition, the mechanical strength of the substrate can be maintained by the beam integral with the printing head substrate.

The printing head substrate in the present embodiment is provided with the heaters 6 arranged in one line at each of both the sides of the ink supply opening 3 along the ink supply opening 3, but the printing head substrate in the present invention may be provided with heaters arranged at one side of the ink supply opening 3 along it.

Second Embodiment

In the first embodiment, the beam provided in the printing head substrate is the beam A provided perpendicular to the arrangement direction of the heater array 6 at the center of the ink supply opening 3 and the diode sensor 7-3 is arranged on the beam A, but the present invention is not limited to such a printing head substrate. That is, the configuration of the beam is not necessarily perpendicular to the arrangement direction of the heater array, but the beam may be formed in any configuration as long as the beam integral with the printing head substrate is provided at the ink supply opening 3 and the temperature detecting element is arranged on the beam.

Figure 9:
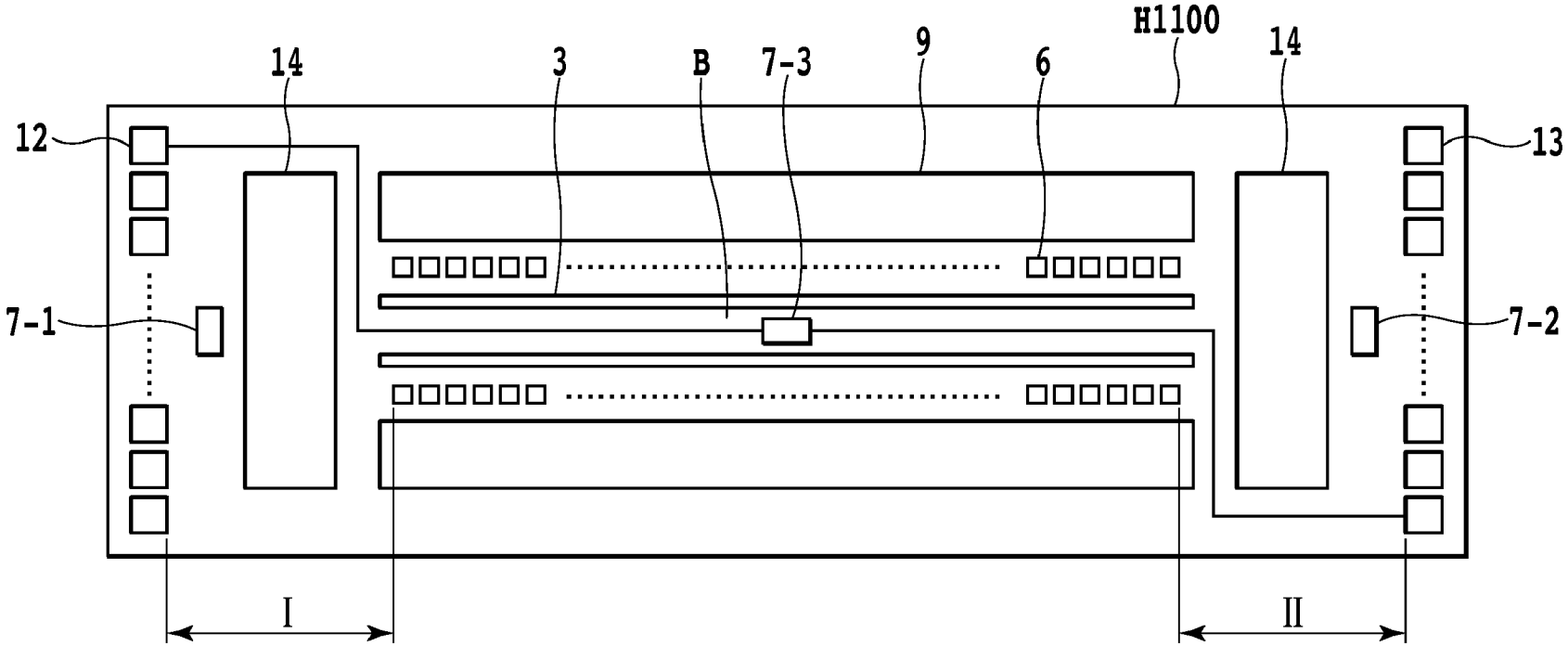
FIG. 9 is a schematic diagram showing a construction of a printing head substrate according to the second embodiment of the present invention.

FIG. 9 is a schematic diagram showing the construction of a printing head substrate in the present embodiment. This construction is formed by changing the structure of the beam A provided in the supply opening 3 in the first embodiment into a structure of a beam B. The respective members other than the beam B in the present embodiment are substantially identical to those in the first embodiment.

In the printing head substrate shown in FIG. 9, the beam B is provided in the center of the ink supply openings 3 along a heater array arrangement direction of the ink supply opening 3. Here, the wire 8 to the diode sensor 7-3 goes through above the beam B and is wired to the input and output pads 12 and 13.

Figure 10:
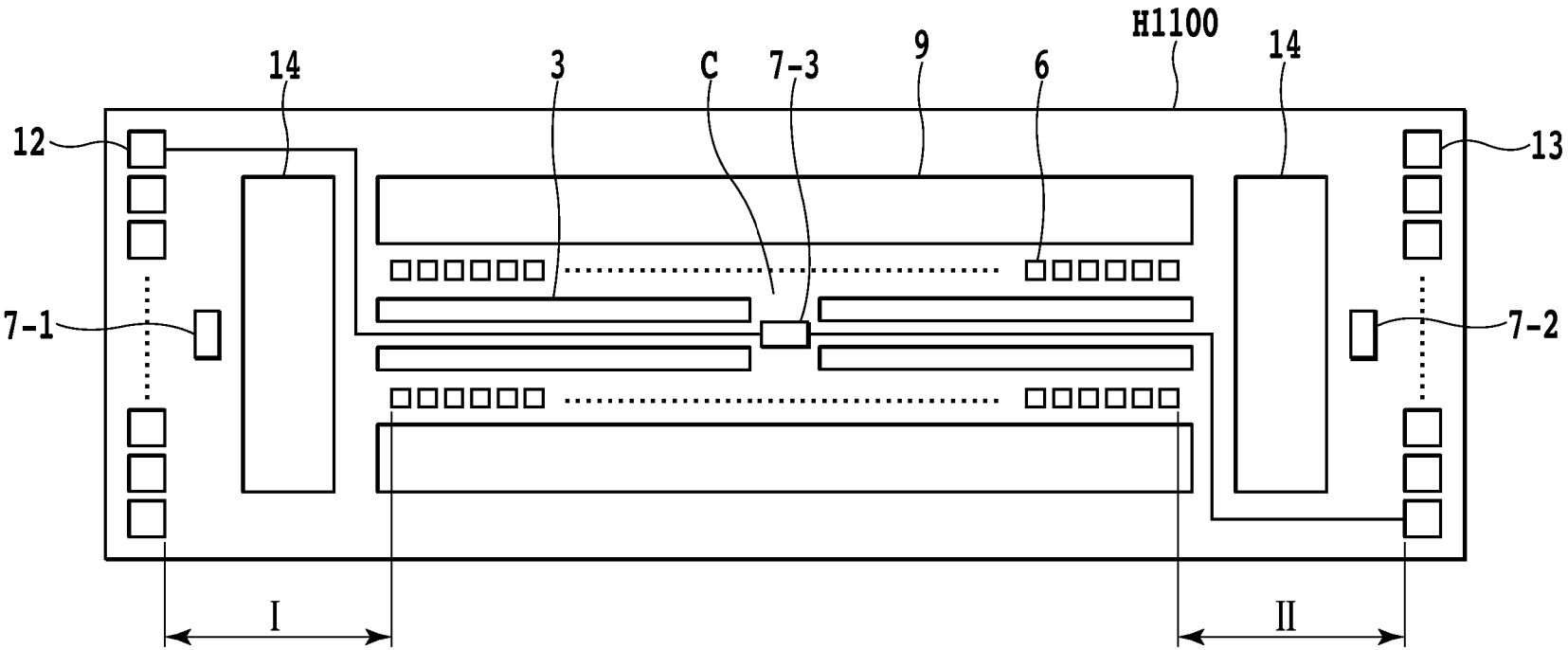
FIG. 10 is a schematic diagram showing another construction of the printing head substrate according to the second embodiment of the present invention.

FIG. 10 is a schematic diagram showing another construction of the printing head substrate in the present embodiment. This construction is formed by changing the structure of the beam A provided in the supply opening 3 in the first embodiment into a structure of a beam C. The respective members other than the beam C in the present embodiment are substantially identical to those in the first embodiment.

In the printing head substrate shown in FIG. 10, the beam C is provided in a cross shape in the center of the ink supply opening 3. The wire 8 extending to the diode sensor 7-3 goes through a part extending in the longitudinal direction of the beam C and is wired to the input and output pads 12 and 13.

Here, the wiring to the diode sensor 7-3, as in the case of the substrate shown in FIG. 9, goes through above the part extending in the longitudinal direction of the beam C, but, as in the case of the substrate shown in the first embodiment, the wiring may go through above a part extending in the short section side direction and be made between the ink supply opening 3 and the heaters 6. A multi wiring may be used to go through a lower layer of the heaters 6 and the driver 9 and be made to the input and output pads 12 and 13.

Figure 11:
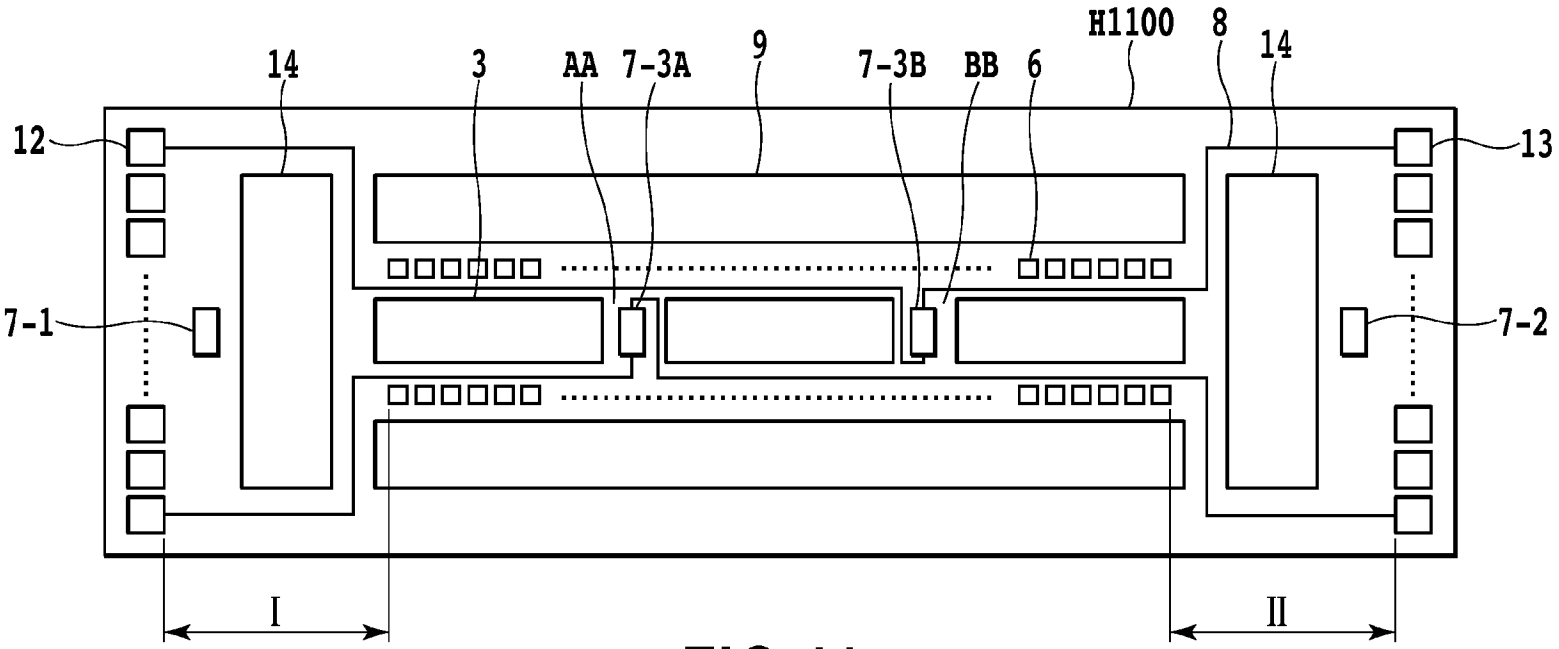
FIG. 11 is a schematic diagram showing another construction of the printing head substrate according to the first embodiment of the present invention.

FIG. 11 is a schematic diagram showing another construction of the printing head substrate in the present embodiment. This construction is formed by changing the structure of the beam A provided in the supply opening 3 in the first embodiment into a structure of a beam AA and a beam BB. The respective members other than the beam AA and the beam BB in the present embodiment are substantially identical to those in the first embodiment.

In the printing head substrate shown in FIG. 11, two beams of the beam AA and the beam BB are provided at the ink supply opening 3 in such a manner as to be shifted from the central part thereof, and diode sensors 7-3A and 7-3B are arranged respectively on the beam AA and the beam BB, where the wiring is made between the ink supply opening 3 and the heaters 6.

The beam provided in the ink supply opening of the printing head substrate shown in FIG. 11 has the same configuration as the beam A in the first embodiment, and two beams and two diode sensors are provided. However, the configuration of the beam is not limited to such a configuration, and three or more beams and diode sensors may be provided. In this case, the number of the beams is not required to be equal to the number of the diode sensors. Further, a multi wiring may be used to go through a lower layer of the heaters 6 and the driver 9 and be made to the input and output pads 12 and 13.

Figure 12:
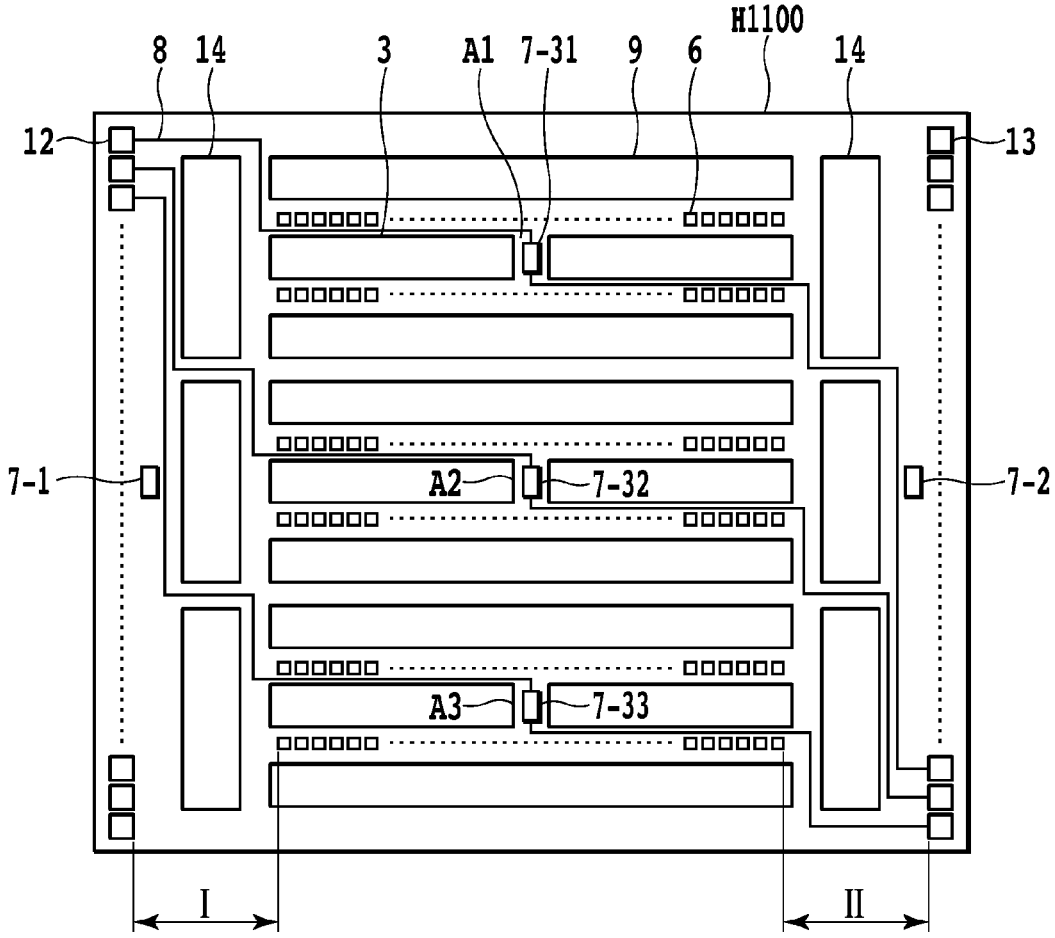
FIG. 12 is a schematic diagram showing another construction of the printing head substrate according to the first embodiment of the present invention.

FIG. 12 is a schematic diagram showing another construction of the printing head substrate in the present embodiment. This shows the construction where a plurality of lines of the supply openings 3 of the printing head substrate in the present embodiment are arranged.

In the printing head substrate shown in FIG. 12, the ink supply openings 3 are formed as through bores extending in the longitudinal direction. A plurality of heaters 6 are provided along the supply opening 3, and the driver parts 9, the heater logic circuit parts 14 and a plurality of pads 12 and 13 are provided. A diode sensor 7-1 is located within a region I formed between the input pad 12 and an end of the nearest heater from the input pad 12, and a diode sensor 7-2 is located within a region II formed between the output pad 13 and an end of the nearest heater from the output pad 13. Each of beams A1, A2 and A3 is located in the center of the ink supply opening, and diode sensors 7-31, 7-32 and 7-33 are located respectively on the beams A1, A2 and A3. The wire 8 extending to each of the diode sensors 7-31, 7-32 and 7-33 goes between the heaters 6 and the ink supply opening 3 and is wired to the input and output pads 12 and 13. Further, a multi wiring may be used to go through a lower layer of the heaters 6 and the driver 9 and be made to the input and output pads 12 and 13. The configuration of the beam is not limited to such a configuration, but may be made as shown in FIGS. 9 to 11.

In FIG. 12, three lines of the ink supply openings 3 are explained, but four or more ink supply openings may be provided, the number of the beams may be four or more and four or more diode sensors may be provided.

When the temperature detecting elements are arranged as described above, it is possible to accurately detect a temperature of each part within the printing head substrate.

In the printing head substrate of the present embodiment, the heaters 6 are arranged in one line at each of both the sides of the ink supply opening 3 along the ink supply opening 3, but in the printing head substrate of the present invention, the heaters may be arranged at one side of the ink supply opening 3 along the ink supply opening 3.

Comparative Example

Figure 13:
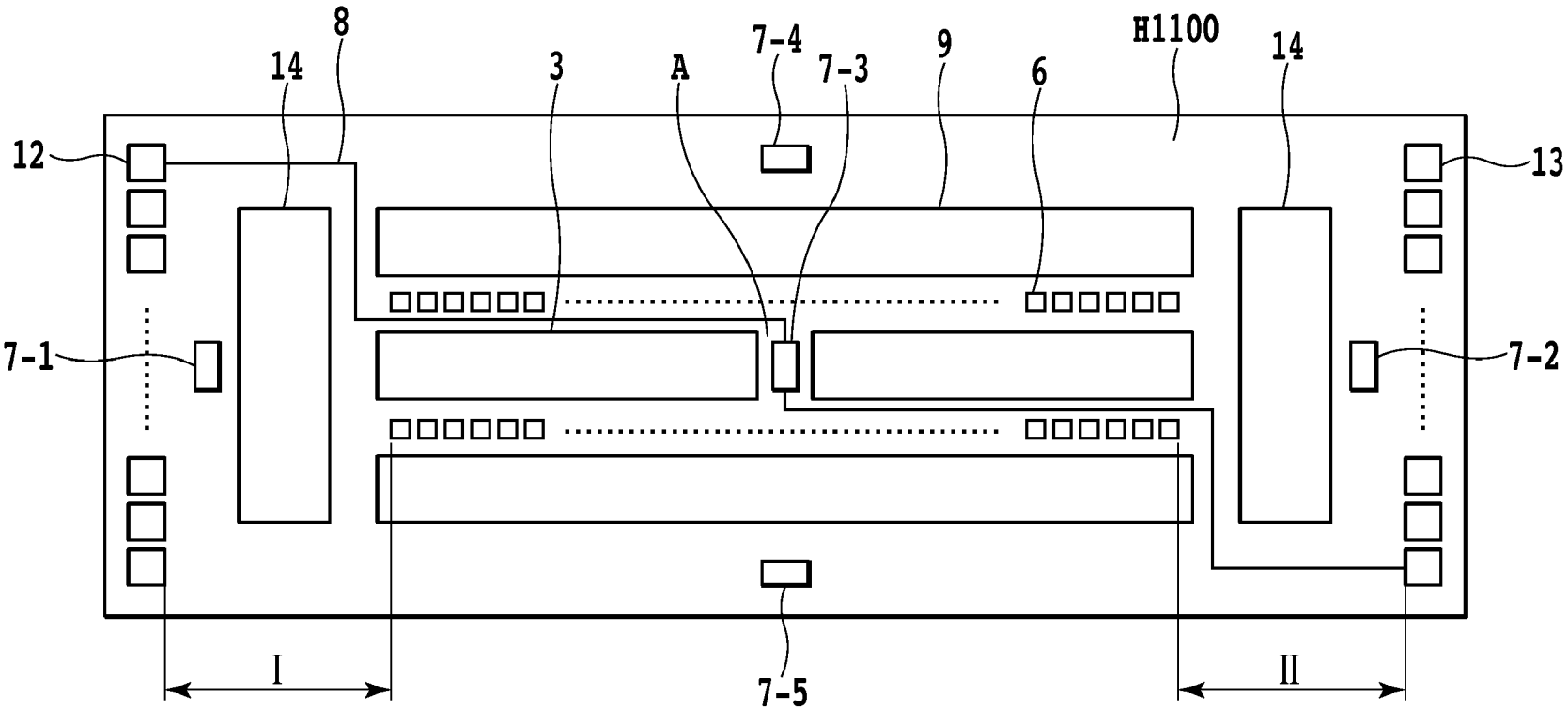
FIG. 13 is a diagram showing a printing head substrate to which a diode sensor is added.

FIG. 13 is a diagram showing a printing head substrate to which diode sensors 7-4 and 7-5 are added. The printing head substrate H1100 is constructed so that in the printing head substrate shown in the first embodiment, diode sensors 7-4 and 7-5 respectively are further added outside the drivers 9 at the central part of the substrate. The printing is carried out by the ink jet printing apparatus using this printing head substrate H1100.

Figure 14:
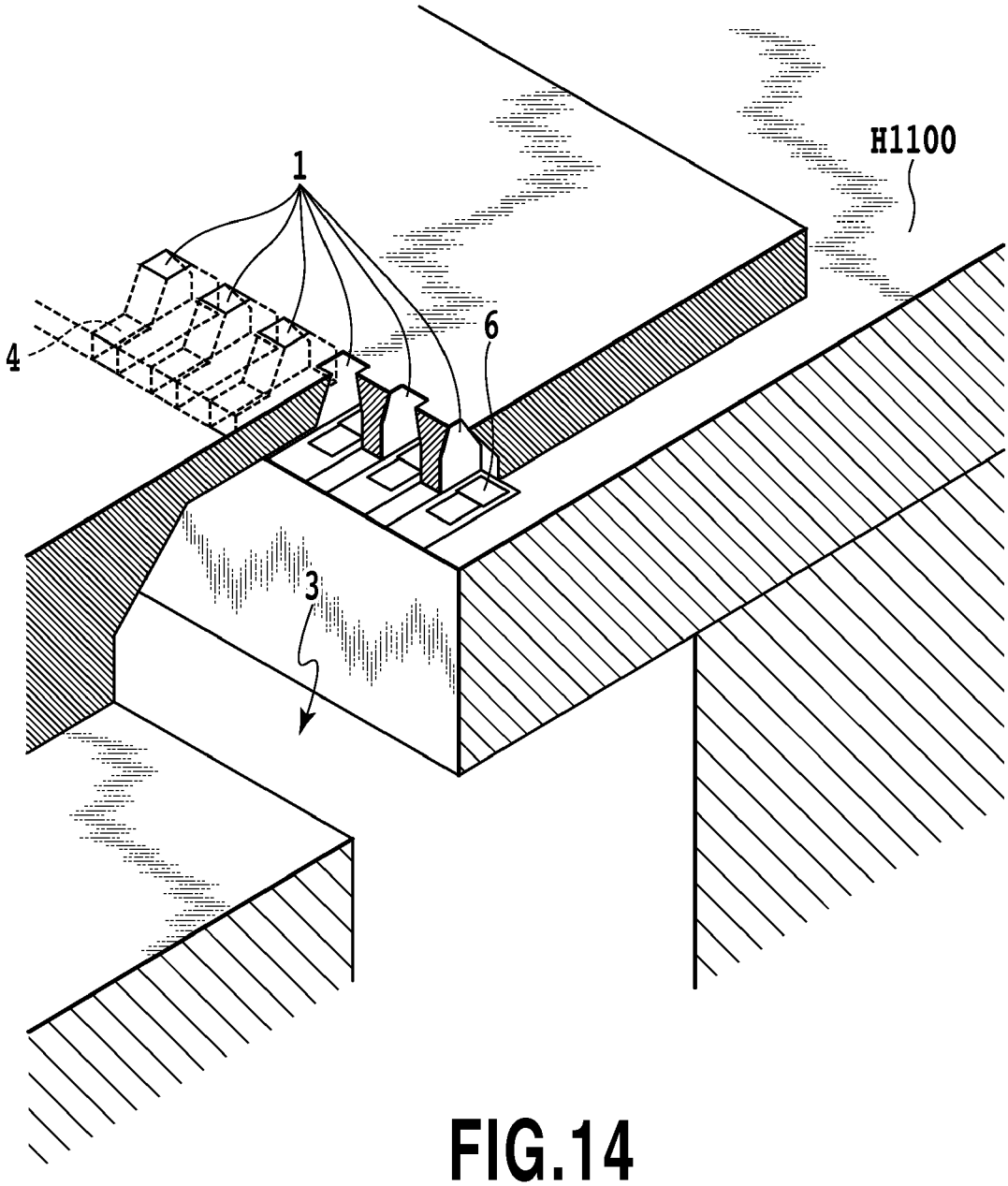
FIG. 14 is a schematic construction diagram of the printing head substrate shown in FIG. 13.

FIG. 14 is a schematic construction diagram of the printing head substrate H1100 shown in FIG. 13. In FIG. 14, for the convenience of explanation, only the heaters 6 at one side of the ink supply opening 3 and the ejection openings 1 corresponding to these heaters 6 are displayed. An actual printing was carried out by the ink jet printing apparatus using such a printing head substrate H1100 to compare quality in printing.

Figure 15:
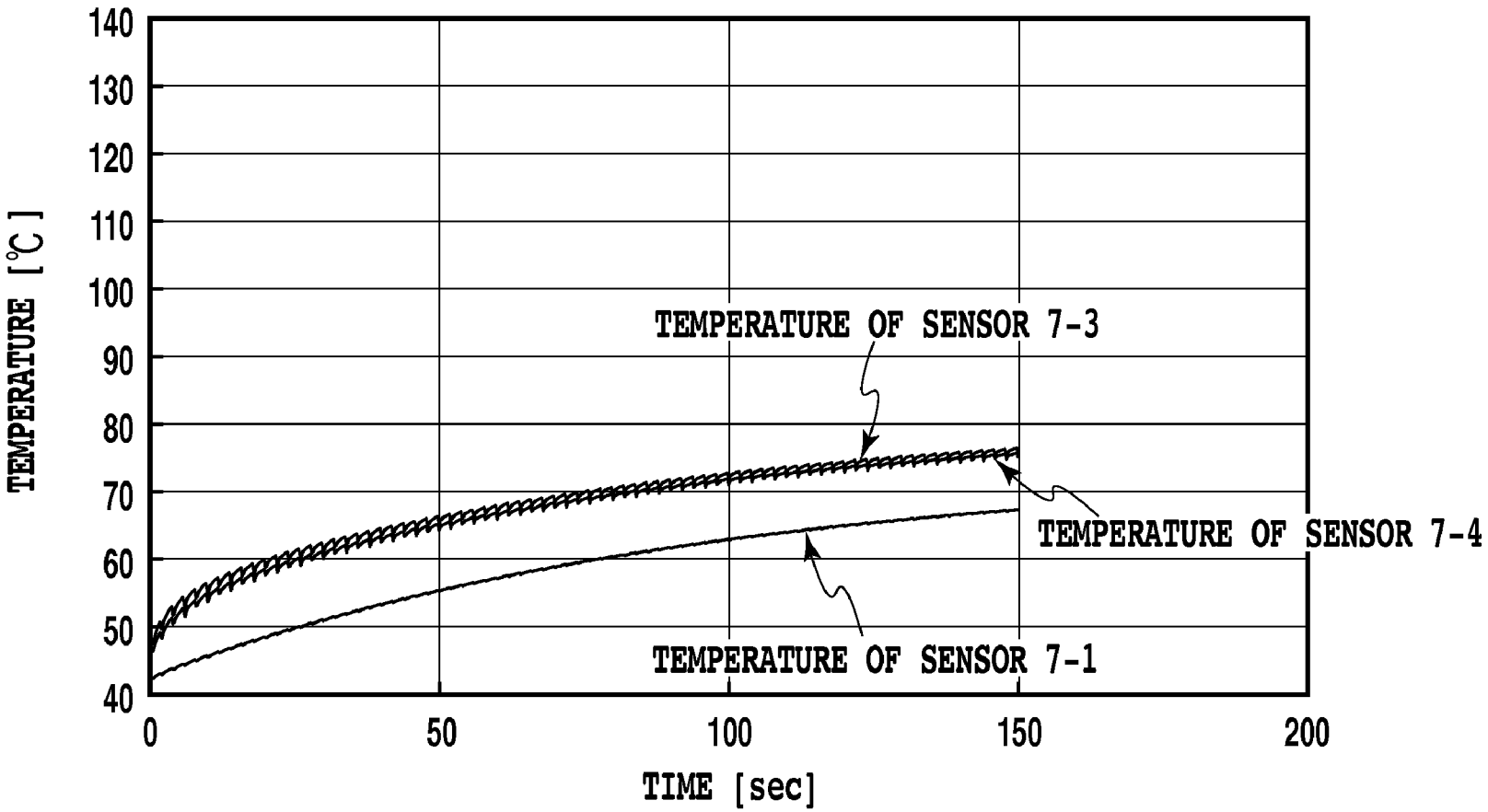
FIG. 15 is a graph showing a temperature change in each part of the substrate at heater driving in a case where ink is supplied as usual.
Figure 16:
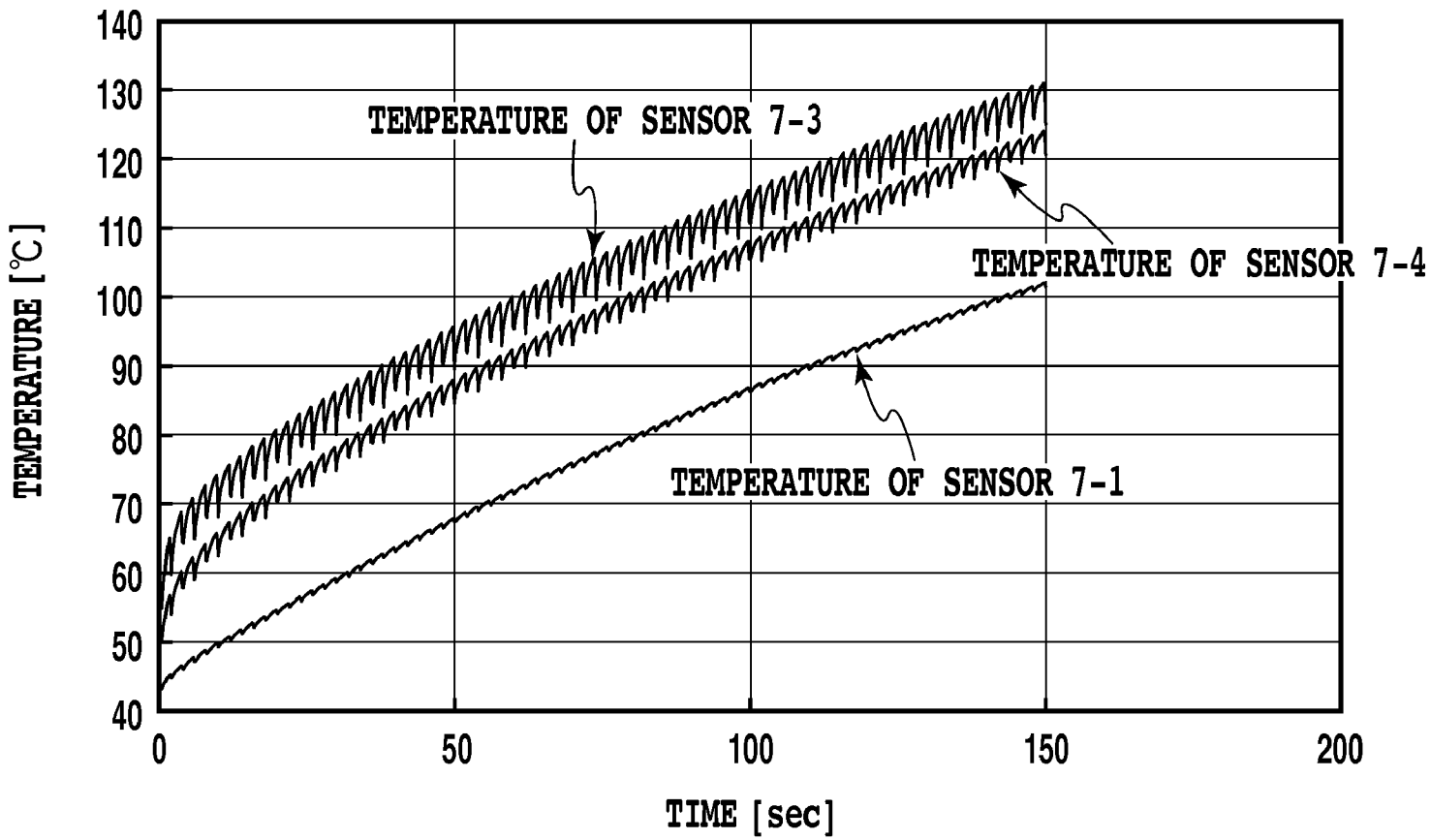
FIG. 16 is a graph showing a temperature change in each part of the substrate at heater driving in a case where the ink is not supplied.

FIG. 15 is a graph showing a temperature change at each part of the substrate at heater driving in a case where the ink supply is regularly carried out. FIG. 16 is a graph showing a temperature change at each part of the substrate at heater driving in a case where the ink supply is not carried out.

In FIGS. 15 and 16, it is found out that, as compared to the sensor 7-1 arranged in the adjacency of the input and output pads as conventional, the sensor 7-3 on the beam and the sensor 7-4 arranged outside the driver at the central part of the substrate according to the present invention detect the higher temperature at the central part of the substrate.

From FIG. 15, it is found out that a measurement temperature by the sensor 7-3 on the beam in the first embodiment is substantially equal to a measurement temperature by the sensor 7-4 outside the driver. In view of this result, it is found out that in a case of performing the temperature detection on the beam, even in a state where the ink supply is being made, a temperature of the substrate is accurately detected independently of a temperature of the ink.

From FIG. 16, in a state where the ink is not supplied, that is, in a case where ink drain occurs, as compared to the sensor 7-4 outside the driver, the sensor 7-3 on the beam detects the higher temperature. From this result, it is found out that in a case of arranging the sensor on the beam, the temperature at ink drain can be more quickly detected.

According to the construction described above, in a case of continuing to carry out the printing in a state where the printing is continuously carried out for a long time and the head temperature becomes high, it is possible to restrict occurrence of the variations.

Third Embodiment

The printing head substrate in the aforementioned embodiment is provided with the beam located at the ink supply opening to be integral with the printing head substrate and the temperature detecting element (diode sensor) is arranged on the beam. The present invention may be a printing head substrate provided with a logic circuit such as a shift resister and a driver transistor in such a manner as to individually read out the substrate temperature detecting elements.

Figure 17:
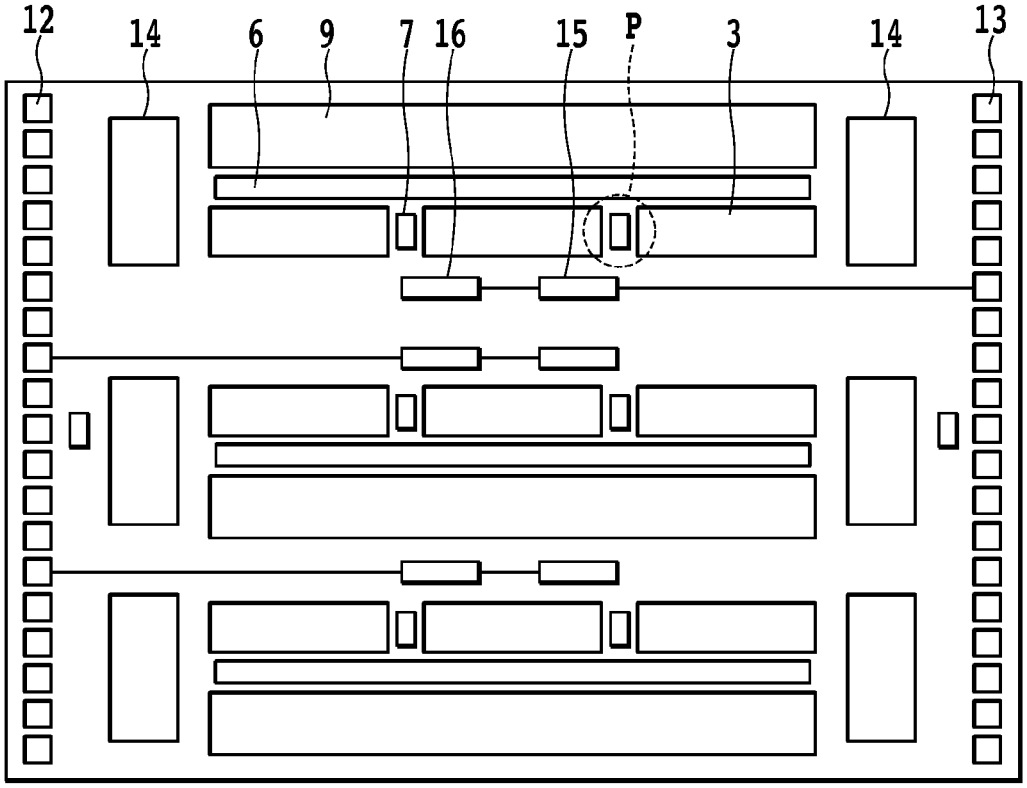
FIG. 17 is a schematic diagram showing a construction of a printing head substrate according to the third embodiment of the present invention.

FIG. 17 is a schematic diagram showing a printing head substrate in the present embodiment. The heaters 6 (heating elements) are arranged in one line at one side of the ink supply opening 3 along the ink supply opening 3. Logic circuits 14 such as shift resistors for driving the heaters 6 are arranged at both sides of each heater array 6, and a driver transistor (driver 9) for heater drive is arranged in parallel with the heater array 6. The external connection terminals 12 and 13 such as power source terminals for supply to the heaters 6, power source terminals for the logic circuit and data signal terminals are arranged along ends of the substrate at short section sides of the ink supply opening 3.

Next, a circuit block layout in the periphery of the temperature sensor in the present embodiment will be explained. The logic circuit 15 and the driver transistor 16 selectively driving the temperature sensor are arranged in the adjacency of the temperature sensor 7 at an opposite side to the heater array centering the ink supply opening 3. This arrangement restricts an influence of heat from the heater 6 to logic circuit 15 and the driver transistor 16 and therefore, it is possible to perform a temperature detection by the temperature sensor 7 at a stable operation.

Figure 18:
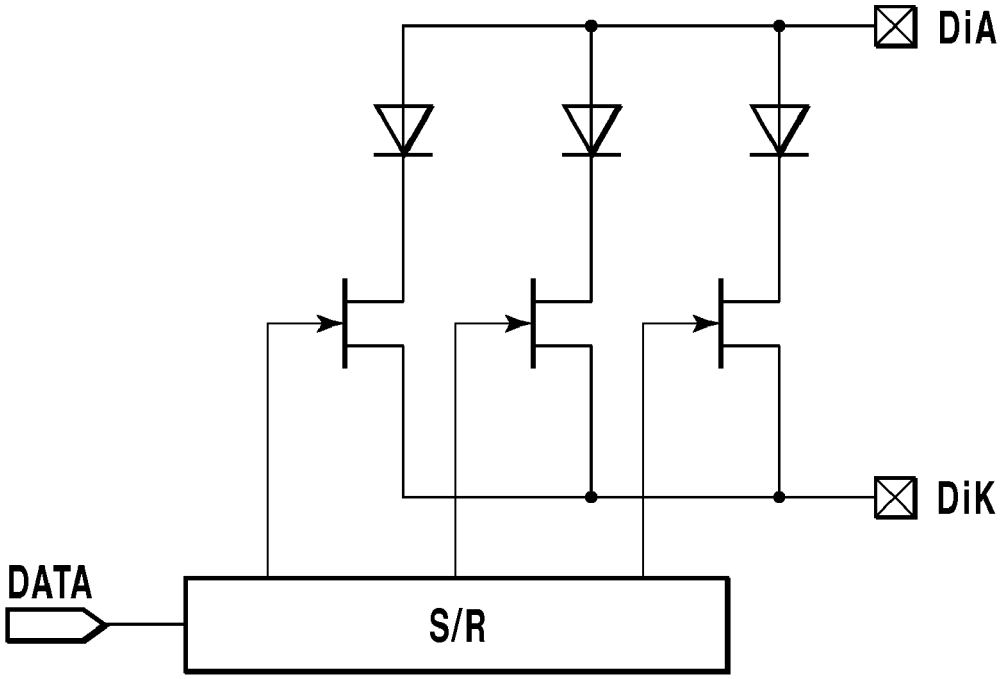
FIG. 18 is a block circuit diagram showing a temperature sensor selection drive according to the third embodiment of the present invention.

FIG. 18 is a block circuit diagram showing a temperature sensor selecting drive. A data signal inputted from the external connection terminal selects a diode sensor by the logic circuit 15 such as the shift resistor to switch on the drive transistor, making it possible to perform temperature detection by a desired temperature sensor. Usually, for reading out the temperature sensor, constant current is applied to the diode sensor by a constant current circuit (not shown) and a voltage decreasing amount of the diode sensor is read out, thus performing the temperature detection.

Fourth Embodiment

In the third embodiment, each of the logic circuits 15 for temperature sensor arranged at the respective arrays has the driver transistor 16, but the present invention is not limited to such an arrangement.

Figure 19:
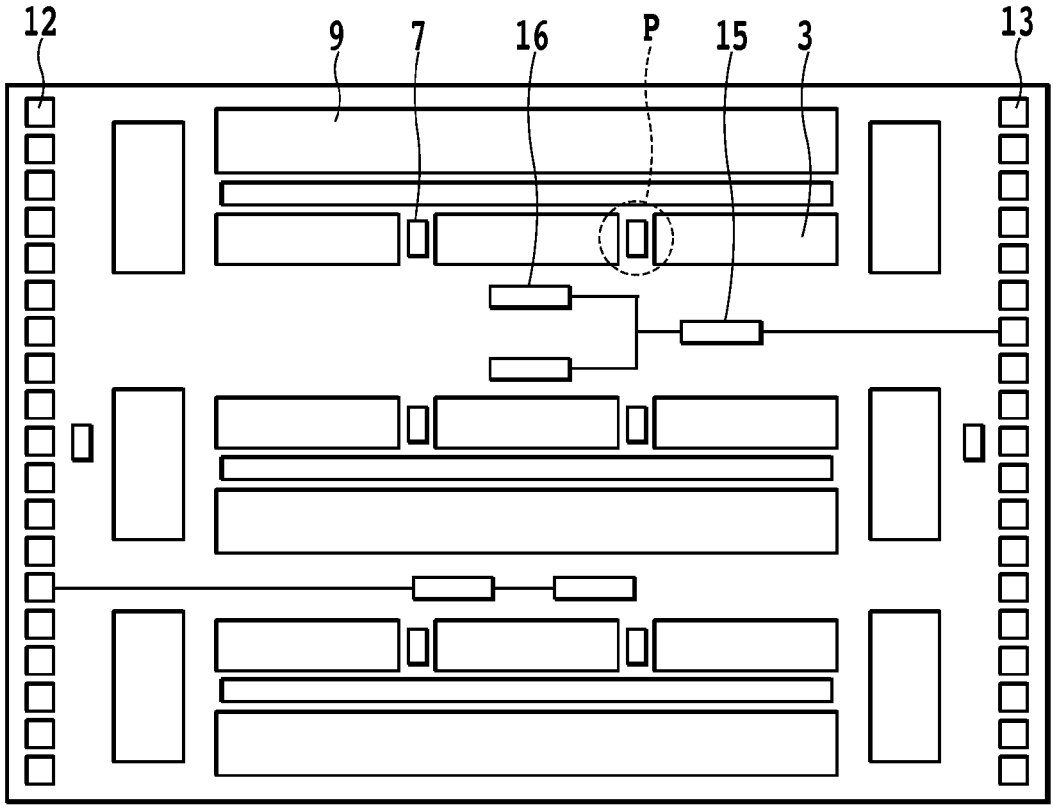
FIG. 19 is a schematic diagram showing a construction of a printing head substrate according to the fourth embodiment of the present invention.

FIG. 19 is a schematic diagram showing a printing head substrate in the present embodiment. In the present embodiment, for elimination of the connection terminal number, the logic circuits 15 in the neighboring arrays are put together to form a data signal line and a single logic circuit 15, which is connected to one external connection terminal.

The present invention is not limited to such an arrangement, but may be constructed so that three or more logic circuits or the logic circuits of all ink supply openings are put together to form a single signal line.

Fifth Embodiment

Figure 20:
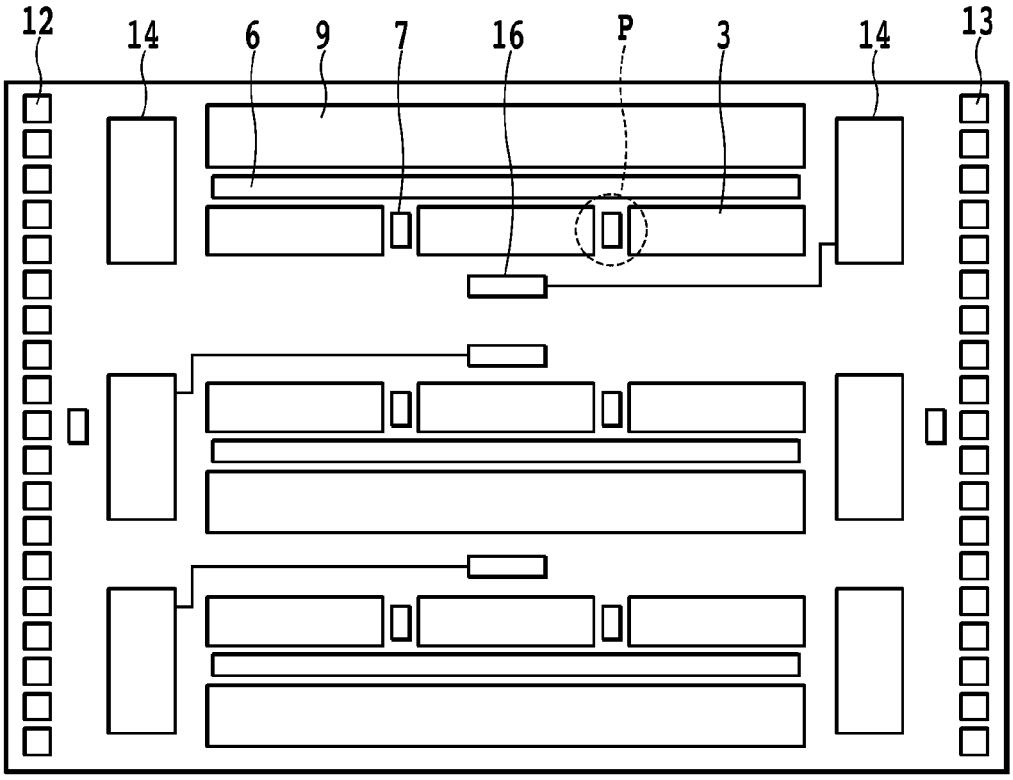
FIG. 20 is a schematic diagram showing a construction of a printing head substrate according to the fifth embodiment of the present invention.
Figure 21:
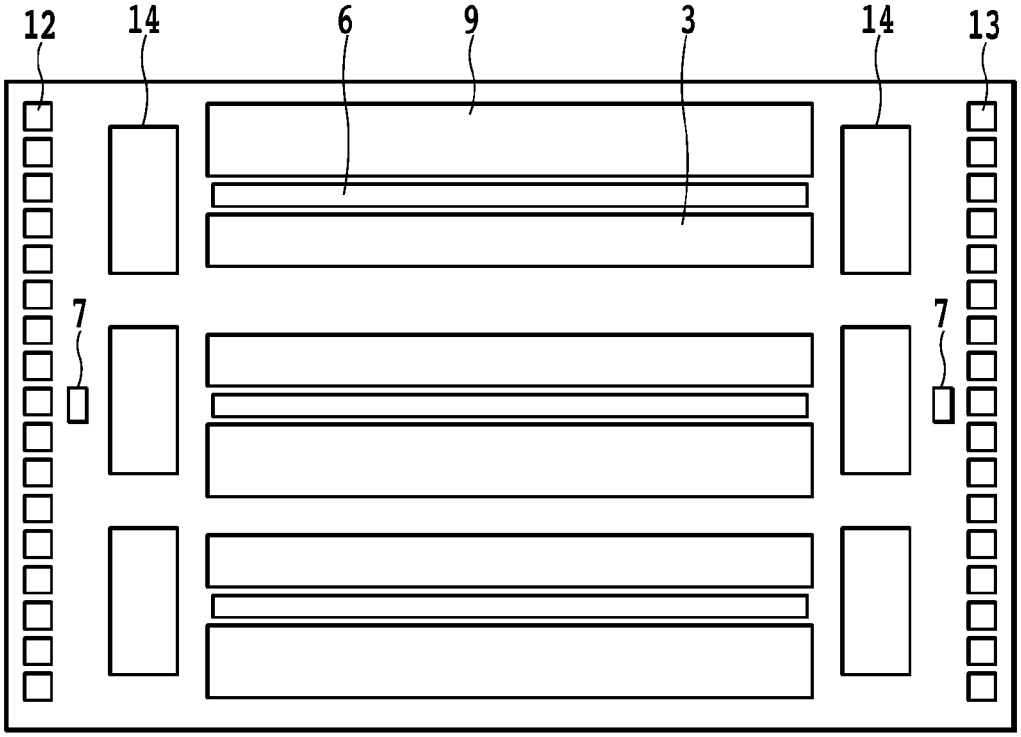
FIG. 21 is a schematic diagram showing a construction of the conventional printing head substrate.
Figure 22:
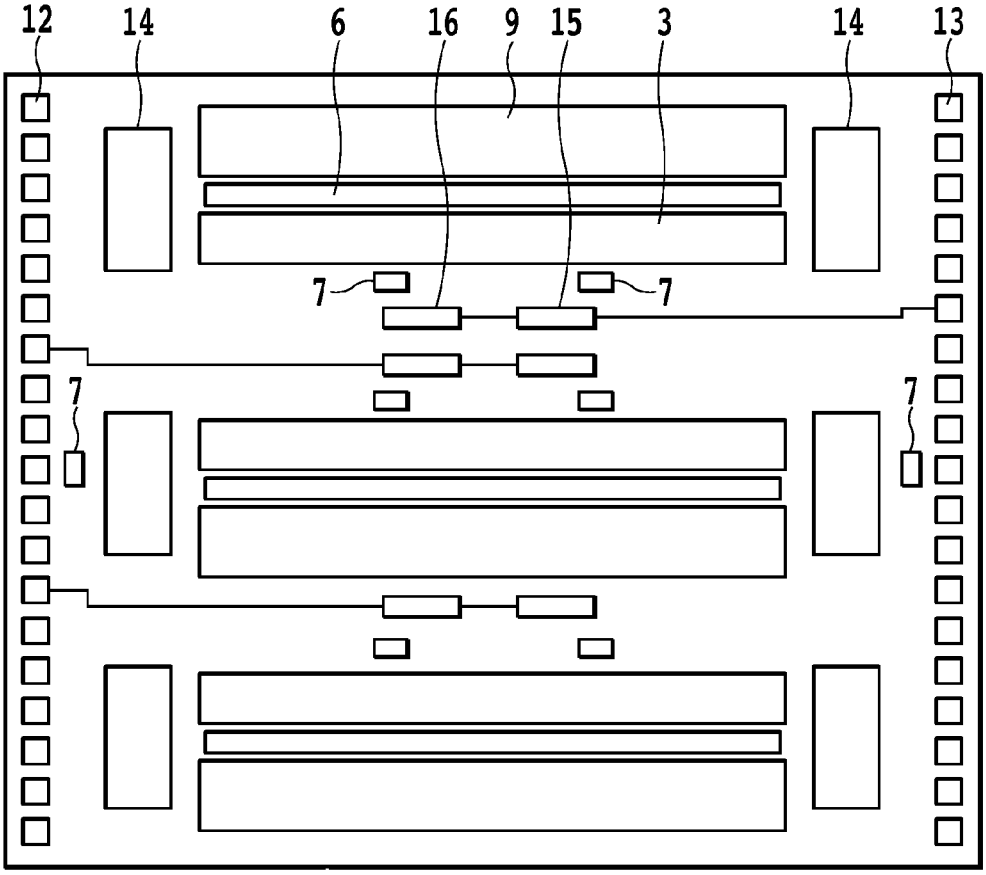
FIG. 22 is a schematic diagram showing a construction of the conventional printing head substrate.

In the aforementioned embodiment, each driver transistor 16 has the logic circuit 15 for temperature sensor, but the logic circuit 14 for temperature sensor selection may be commonly used as a logic circuit for heater selection FIG. 20 is a schematic diagram showing a printing head substrate in the present embodiment. In the present embodiment, the logic circuit 14 for temperature sensor selection is commonly used as the logic circuit for heater selection. Since a temperature sensor selection signal is inputted from the external connection terminal in response to the heater selection signal, the terminal for temperature sensor selection becomes unnecessary, enabling the temperature monitoring at the desired location by the minimum terminal number. In the present embodiment, since the temperature sensor selection signal is inputted in addition to the heater selection signal, the temperature monitoring is performed only at heater driving.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-157877, filed Jun. 17, 2008, which is hereby incorporated by reference herein in its entirety.

What is claimed is:

1. A printing head substrate comprising:

a board;

a first array provided with a plurality of heating elements generating energy used for ejecting ink from ejection openings on a surface of the board;

a second array provided with a plurality of heating elements generating energy used for ejecting the ink from ejection openings on the surface;

a plurality of ink supply openings for supplying ink to the plurality of heating elements, the plurality of ink supply openings penetrating the surface and a back side of the board and being arranged along the first array and the second array at a region between the first array and the second array;

a first drive transistor circuit for driving the heating elements of the first array;

a second drive transistor circuit for driving the heating elements of the second array;

a substrate temperature detecting element for detecting a temperature of the printing head substrate on the board between ink supply openings;

a pair of pads for carrying out reception and supply of a signal between a printing apparatus and the substrate temperature detecting element on the surface;

a first conductive line connecting the substrate temperature detecting element and one of the pair of pads; and a second conductive line connecting the substrate temperature detecting element and another of the pair of pads;

wherein the first conductive line is provided on the board between the ink supply openings and the first array and the second conductive line is provided on the board between the ink supply openings and the second array.

2. The printing head substrate according to claim 1, wherein the substrate temperature detecting element comprises a diode sensor.

3. An ink jet printing head using the printing head substrate according to claim 1.

4. An ink jet printing apparatus using the printing head substrate according to claim 1.

5. The printing head substrate according to claim 1, wherein the first array, the plurality of the supply openings and the second array are provided between the first drive transistor circuit and the second drive transistor circuit.

6. The printing head substrate according to claim 1, wherein one of the pair of pads is provided near to a first side of the board, and another of the pair of pads is provided near to a second side of the board.

* * * * *